US008822867B2

(12) United States Patent
Lee

(10) Patent No.: US 8,822,867 B2
(45) Date of Patent: Sep. 2, 2014

(54) GAS INSULATED SWITCHGEAR

(75) Inventor: Jong Hyuk Lee, Cheongju-Si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 247 days.

(21) Appl. No.: 13/556,113

(22) Filed: Jul. 23, 2012

(65) Prior Publication Data

US 2013/0026138 A1 Jan. 31, 2013

(30) Foreign Application Priority Data

Jul. 25, 2011 (KR) ..... 10-2011-0073802

(51) Int. Cl.
*H01H 33/88* (2006.01)
*H01H 33/06* (2006.01)
*H01H 33/24* (2006.01)

(52) U.S. Cl.
CPC ..... *H01H 33/24* (2013.01); *H01H 33/245* (2013.01); *H01H 33/06* (2013.01)
USPC ..... 218/59

(58) Field of Classification Search
USPC ..... 218/43, 59
See application file for complete search history.

(56) References Cited

U.S. PATENT DOCUMENTS 4,535,383 A 8/1985 Yamaoka et al.
5,723,839 A * 3/1998 Kozawa ..... 218/43
6,163,002 A 12/2000 Ahn et al.
6,515,248 B2 * 2/2003 Imamura et al. ..... 218/59
7,868,755 B2 * 1/2011 Hanai et al. ..... 340/539.22
2002/0144977 A1 10/2002 Kikuchi et al.
2003/0127430 A1 * 7/2003 Iwabuchi et al. ..... 218/43
2004/0164051 A1 8/2004 Stoving et al.
2009/0008229 A1 * 1/2009 Granhaug et al. ..... 200/275

FOREIGN PATENT DOCUMENTS

JP 05-199626 8/1993
JP 10-155215 6/1998
RU 2178927 1/2002
SU 1345271 10/1987
SU 1700628 12/1991

OTHER PUBLICATIONS

Russian Federation Federal Service for Intellectual Property, Patents and Trademarks Application Serial No. 2012131742/07, Notice of Allowance dated Nov. 18, 2013, 8 pages.

* cited by examiner

*Primary Examiner* — Truc Nguyen
(74) *Attorney, Agent, or Firm* — Lee, Hong, Degerman, Kang & Waimey

(57) ABSTRACT

A gas insulated switchgear includes: an upper conductor; a lower conductor; a movable contact provided in the upper conductor; a fixed contact fixedly provided in the lower conductor; a moving side tulip contact provided in the movable contact; a moving side shield fixed to the upper conductor; a fixed side tulip contact provided in the fixed contact; a fixed side shield fixed to the lower conductor; and an insulating screen unit installed to selectively block the opening end of the moving side shield and covering an end of the movable contact when the movable contact is separated from the fixed contact.

15 Claims, 9 Drawing Sheets

GAS INSULATED SWITCHGEAR

The present disclosure relates to subject matter contained in priority Korean Application No. 10-2011-0073802, filed on Jul. 25, 2011, which is herein expressly incorporated by reference in its entirety.

1. FIELD OF THE INVENTION

The present invention relates to an apparatus for reducing an electric field between a movable contact and a fixed contact in a disconnecting switch of a gas insulated switchgear.

2. DESCRIPTION OF THE RELATED ART

In general, a gas insulated switchgear is a switching device of an ultra-high electric power system which is installed in an electrical line and used for indoor and outdoor power station and a power transmission plant to safely interrupt an abnormal current such as a fault current, a short current, or the like, when occurs, as well as switch a load current on purpose in a normal usage state, to thus protecting the electric power system and power device.

The gas insulated switchgear, including various component devices such as a current breaker (CB), a disconnecting switch (DS), a current transformer (CT), an earthing switch (ES), and the like, is installed within an earthed metal tank, and the interior of the tank is filled with sulfur hexafluoride ($SF_6$) gas having high insulating capability.

FIGS. 1 and 2 are vertical sectional views showing a contact structure in a closed circuit state and an open circuit state of a disconnecting switch of a related art gas insulated switchgear, respectively.

As illustrated, the related art disconnecting switch includes a movable contact 11 coupled to an upper conductor 1 and making a linear reciprocal movement with respect to the upper conductor 1, and a fixed contact 21 coupled to a lower conductor 2 spaced apart from the upper conductor 1 by a certain interval and selectively being brought into contact with the movable contact 11 or separated therefrom.

The movable contact 11 is coupled to be moved in a vertical direction toward the fixed contact 2 by a movable link 3 rotatably coupled to the upper conductor 1.

A moving side tulip contact 12 is provided at a lower end of the moving conductor 1. The moving side tulip contact 12 is connected to a fixed side tulip contact 22 as described hereinafter through the movable contact 11. A moving side shield 13 for protecting the moving side tulip contact 12 is coupled to the upper conductor 1.

A lower surface of the moving shield 13 includes an opening end 13*a* allowing the movable contact 11 to pass therethrough.

The fixed contact 21 is provided in a straight line with respect to the movable contact 11. The fixed side tulip contact 22, which is connected to the moving side tulip contact 12 through the movable contact 11, is provided at an end of the lower conductor, and a fixed side shield 23 formed on an outer surface of the fixed side tulip contact 22 to protect the fixed side tulip contact 22 is coupled to the lower conductor 2.

An upper surface of the fixed side shield 23 may have an opening end 23*a* allowing the fixed contact 21 to pass therethrough.

When the disconnecting switch of the related art gas insulated switchgear is required to be closed (closed circuit), a driving unit operates to rotate the movable link 3 connected to the driving unit in a counterclockwise direction in FIG. 2. Then, the movable contact 11 connected to the movable link 3 downwardly slides toward the fixed contact 21 and a mover is inserted into the fixed contact 21, transitioning to a closed circuit.

Meanwhile, when the disconnecting switch is required to be open (open circuit), the driving unit operates to rotate the movable line 3 in the opposite direction, namely, in a clockwise direction, in FIG. 1. Then, the movable contact 11 upwardly slides to become distant from the fixed contact 21, thus being separated from the fixed contact 21, transitioning to an open circuit. Here, since an electric field is concentrated on the end of the movable contact 11 and that of the fixed contact 21, the electric field is lessened by using the moving side shield 13 and the fixed side shield 23.

However, in the related art gas insulated switchgear, a high electric field is still concentrated between the movable contact 11 and the fixed contact 21, having a possibility that a secondary electrical accident may occur and the contacts may be contaminated by a gas resulting from an arc.

SUMMARY OF THE INVENTION

An aspect of the present invention provides a gas insulated switchgear capable of reducing a field concentration between contacts and preventing the contacts from being contaminated by installing an insulating structure between the contacts.

According to an aspect of the present invention, there is provided a gas insulated switchgear including: an upper conductor; a lower conductor; a movable contact provided in the upper conductor such that it is movable linearly with respect to the upper contact; a fixed contact fixedly provided in the lower conductor; a moving side tulip contact provided in the movable contact; a moving side shield fixed to the upper conductor, accommodating the moving side tulip contact, and having an opening end allowing the movable contact to pass therethrough; a fixed side tulip contact provided in the fixed contact and selectively connected to the moving side tulip contact by the movable contact; a fixed side shield fixed to the lower conductor and accommodating the fixed side tulip contact; and an insulating screen unit installed to selectively block the opening end of the moving side shield and covering an end of the movable contact when the movable contact is separated from the fixed contact.

The insulating screen unit may include: an insulating screen rotatably coupled to the moving side shield and blocking the opening end of the moving side shield; and a push link slidably coupled to the insulating screen and provided within the moving side in order to rotate the insulating screen within a certain range.

The insulating screen unit may further include: a support spring supporting the push link in a direction of the lower conductor.

The insulating screen unit may further include: a constraint pin provided to be selectively inserted into a lateral surface of the movable contact in order to selectively restrain a movement of the push link; and a constraint spring elastically supporting the constraint pin in the direction of the movable contact.

A push recess may be formed on a lateral surface of the movable contact to allow the constraint pin to be selectively inserted therein, and the push recess may include a stop surface having a step to allow the constraint pin to be caught thereby in the direction of the lower conductor and a guide surface sloped to allow the constraint pin to slide therealong in the direction of the upper conductor.

The insulating screen may include a hinge portion rotatably formed in the moving side shield and a blocking portion formed at the opposite side of the hinge portion to block the opening end of the moving side shield.

A rotation recess may be formed between the hinge portion and the blocking portion in order to allow a push pin provided in the push link to be slidably inserted therein to make the insulating screen rotate when the push link is moved.

The insulating screen unit may include: an insulating screen rotatably coupled to the moving side shield such that it is pushed by the movable contact to open the opening end of the moving side shield; and a return spring coupled between the moving side shield and the insulating screen and providing elastic force to the insulating screen to block the opening end of the moving side shield when the movable contact is returned into the moving side shield.

The insulating screen may include a hinge portion rotatably formed in the moving side shield and a blocking portion formed at the opposite side of the hinge portion to block the opening end of the moving side shield.

A push surface may be formed on an inner circumferential surface of the blocking portion and disposed to be in contact with the movable contact such that it is eccentric with respect to a central line of a movement direction of the movable contact.

The foregoing and other objects, features, aspects and advantages of the present invention will become more apparent from the following detailed description of the present invention when taken in conjunction with the accompanying drawings.

DETAILED DESCRIPTION OF THE INVENTION

A gas insulated switchgear according to embodiments of the present invention will be described in detail with reference to the accompanying drawings.

Figure 1:
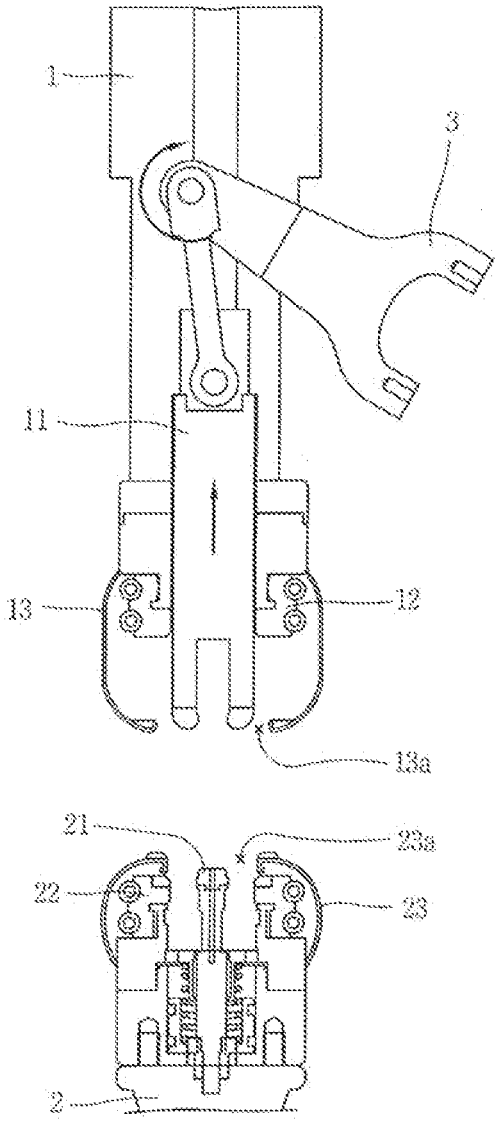
FIG. 1 CONVENTIONAL ART
FIGS. 1 and 2 are vertical sectional views showing contact structures in a closed circuit state and an open circuit state of a disconnecting switch in a related art gas insulating switchgear, respectively.
Figure 2:
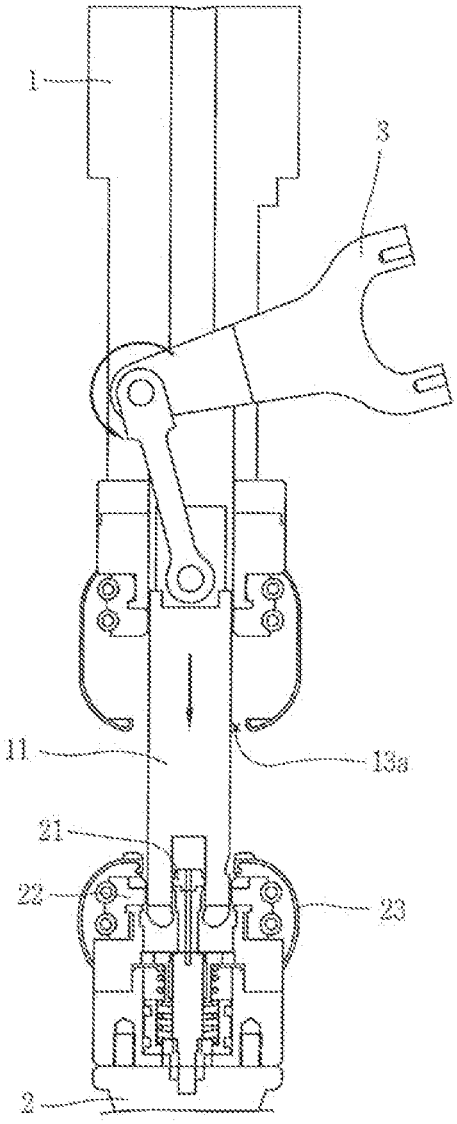
FIG. 2 CONVENTIONAL ART
Figure 3:
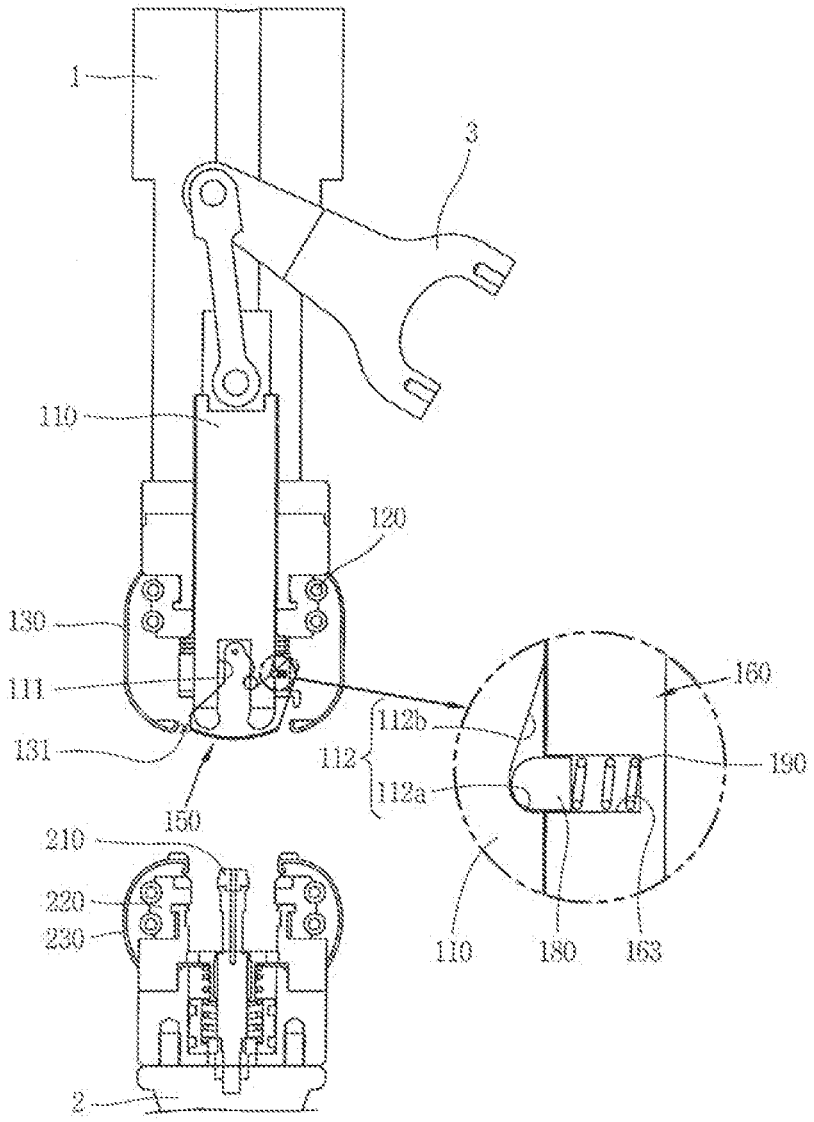
FIG. 3 is a vertical sectional view showing a contact structure of a disconnecting switch in a gas insulating switchgear according to an embodiment of the present invention.
Figure 4:
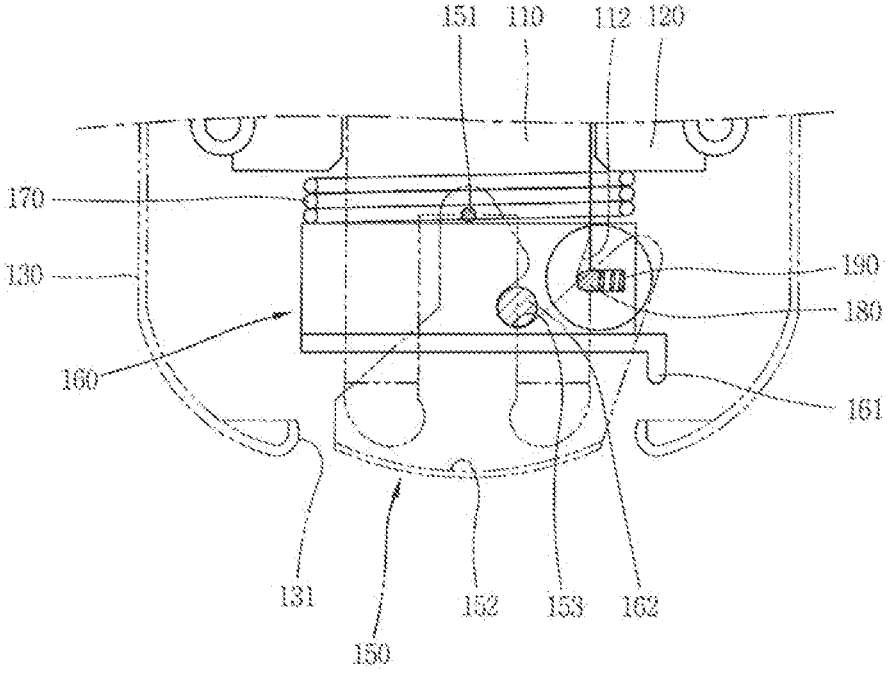
FIG. 4 is an enlarged schematic view of an insulating screen unit of the contact structure in FIG. 3.
Figure 5:
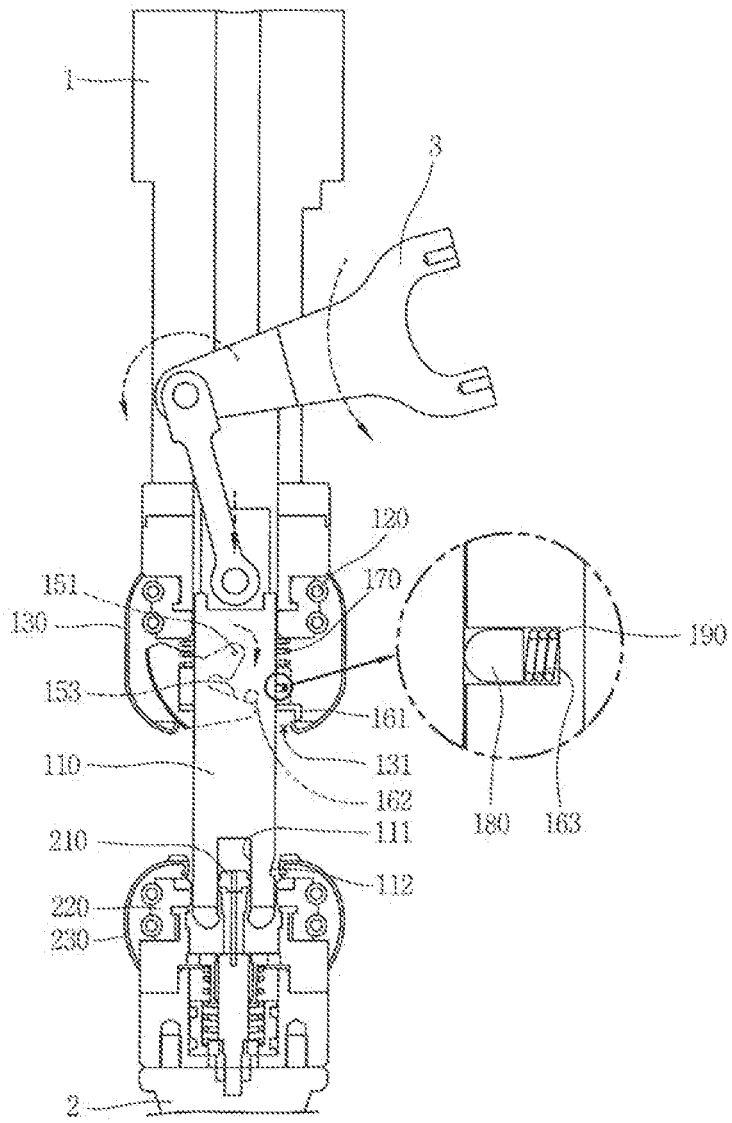
FIGS. 5 and 6 are vertical sectional views showing contact structures in a closed circuit state and an open circuit state of the disconnecting switch in FIG. 3, respectively.
Figure 6:
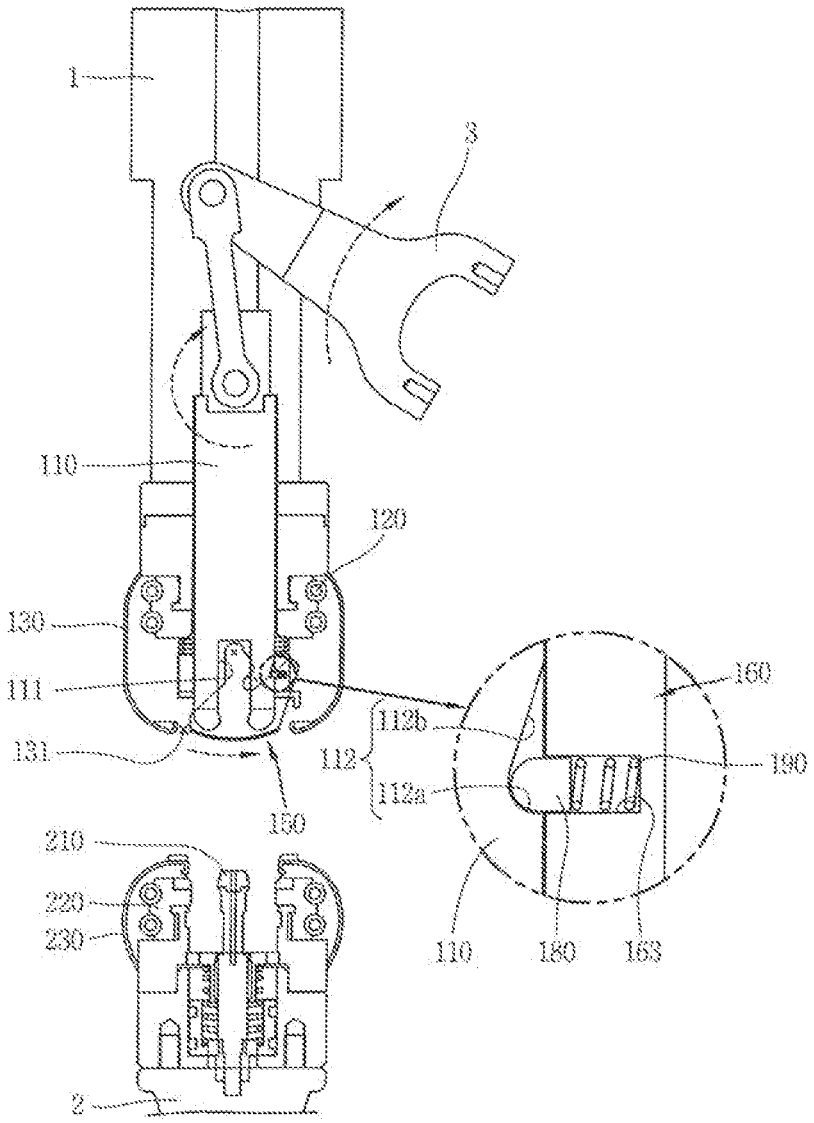

FIG. 3 is a vertical sectional view showing a contact structure of a disconnecting switch in a gas insulating switchgear according to an embodiment of the present invention. FIG. 4 is an enlarged schematic view of an insulating screen unit of the contact structure in FIG. 3. FIGS. 5 and 6 are vertical sectional views showing contact structures in a closed circuit state and an open circuit state of the disconnecting switch in FIG. 3, respectively;

As shown in FIGS. 3 and 4, in a disconnecting switch of the gas insulated switchgear according to the present embodiment, an upper conductor 1 and a lower conductor 2 are insulated and spaced apart by a certain interval from each other. A movable contact 110 is coupled tot a movable line 3 in the upper conductor 1 such that the movable contact 110 is movable linearly with respect to the upper conductor 1, and a fixed contact 210 is fixedly coupled to the lower conductor 2.

A moving side tulip contact 120 is coupled to an end of the upper conductor 1, and a moving side shield 130 is installed at an outer side of the moving side tulip contact 120 to cover the moving side tulip contact 120 in order to prevent concentration of an electric field on the moving side tulip contact 120. The moving side shield 130 has a cylindrical shape with both ends thereof opened, and one opening end (referred to as a 'first opening end', hereinafter) (no reference numeral given) is fixedly inserted into a lower end of the upper conductor 1, and the other opening end (referred to as a 'second opening end', hereinafter) 131 of the moving side shield 130 is coupled to face the fixed contact 210.

A contact insertion recess 111 having a certain depth is formed in the end of the movable contact 110 to allow the fixed contact 210 to be inserted therein.

The fixed contact 210 is provided in the end of the lower conductor 2, and the fixed side tulip contact 220 is coupled in the vicinity of the fixed contact 210, and a fixed side shield 230 is installed at an outer side of the fixed side tulip contact 220 in order to prevent concentration of an electric field on the fixed side tulip contact 220.

In the gas insulated switchgear according to an embodiment of the present invention, when the disconnecting switch is closed, as shown in FIG. 5, a driving unit operates and the movable contact 110 is rotated together with the movable link 3 to slide linearly with respect to the upper conductor 1 and move downwardly toward the fixed contact 210. Then, the fixed contact 210 is insertedly coupled to the contact insertion recess 111 of the movable contact 110.

Meanwhile, when the disconnecting switch is open, as shown in FIG. 6, the driving unit operates in a direction the reverse to the case of the closed circuit and the movable contact 110 is rotated along with the movable link 3 in a direction the reverse to the direction of the case of the open circuit so as to slide linearly with respect to the upper conductor 1 and move upwardly to become distant from the fixed contact 210. Then, the fixed contact 210 is separated to be spaced apart from the contact insertion recess 111 of the movable contact 110.

Here, when an electric field is concentrated between the movable contact 110 and the fixed contact 210, a secondary electrical accident may occur. However, in the present embodiment, when the movable contact 110 is separated from the fixed contact 210, since the insulating screen unit for covering the end of the movable contact 110 is installed, an electric field can be prevented from being concentrated on the movable contact 110 and the fixed contact 210.

As shown in FIG. 4, the insulating screen unit according to the present embodiment may include an insulating screen 150 having a width sufficient for blocking the second opening end 131 of the moving side shield 130 and rotatably coupled within the moving side shield 130, a push link 160 slidably coupled to the insulating screen 150 and rotating the insulating screen 150 within a certain range, a support spring 170 supporting the push link 160 to press the push link 160 toward the fixed contact, a constraint pin 180 selectively restraining elastic force of the support spring 170 to selectively constrain the push link 160 to the movable contact 110, and a constraint spring 190 elastically supporting the constraint pin 180 horizontally toward the movable contact.

The insulating screen 150 may be formed to have a fan-like shape. The insulating screen 150 may have a hinge portion 151 formed at a portion of a vertex and a blocking portion 152 formed at the other side of the hinge portion 151. The hinge portion 151 may be rotatably coupled to the moving side shield 130, and the blocking portion 152 may be formed to have a width sufficient for blocking the second opening end 131 of the moving side shield 130. A rotation recess 153 may be formed at one side of the insulating screen 150, namely, at one side between the hinge portion 151 and the blocking portion 152 such that a push pin 162 of the push link 160 slides to press the insulating screen 150.

The push link 160 has a size by which the push link 160 may be movable within the moving side shield 130. A lower end of the support spring 170 is coupled to an upper end of the push link 160, and a stop portion 161 may be formed on a lower end of the push link 160 such that it is slidably inserted into the rotation recess 153 of the insulating screen 150. The push link 160 include a constraint recess 163 formed in a horizontal direction and having a certain depth to allow the constraint pin 180 and the constraint spring 190 to be inserted therein. The constraint recess 163 may be formed to be in the same horizontal line as a push recess 112 as described hereinafter when the movable contact 110 is completely separated from the fixed contact 210.

The support spring 170 is configured as a compression coil spring such that one end thereof is supported by the moving side tulip contact 120 and the other end thereof is supported by the push link 160.

The constraint pin 180 may be disposed such that it is inserted into the constraint recess 163 of the push link 160 and movable in a direction perpendicular to a movement direction of the movable contact 110, namely, in a horizontal direction, so as to be selectively inserted into the push recess 112 formed in a radial direction at one lateral side of the movable contact 110. As for a length of the constraint pin 180, the constraint pin 180 may have a length, a portion of which can be inserted into the push recess 112 of the movable contact 110 and another portion of which is inserted into the constraint recess 163 of the push link 160. The constraint recess 163 includes a stop surface 112*a* formed in the direction of the lower conductor 2 and a guide surface 112*b* formed to be sloped in the direction of the upper conductor 1.

The constraint spring 190 is configured as a compression coil spring in order to elastically support the constraint pin toward the movable contact 110.

The same reference numerals are used for the same components as those of the related art.

The gas insulated switchgear according to an embodiment of the present invention has the following operational effects.

Namely, in order for the disconnecting switch of the gas insulated switchgear to be changed from an open state to a closed state, the movable link 3 rotates in a counterclockwise direction in FIG. 5. Then, the movable contact 110 coupled to the movable link 3 is moved downwardly, escaping from the second opening end 131 of the moving side shield 130, and inserted into the fixed contact 210. Then, the moving side tulip contact 120 is connected with the fixed side tulip contact 220 by the movable contact 110, thus completing a closing operation.

In this case, when the movable contact 110 starts to move toward the fixed contact 210, the constraint pin 180 insertedly positioned in the push recess 112 of the movable contact 110 slides along the guide surface 112*b* of the push recess 112 so as to escape from the push recess 112. Then, the push link 160 is free from the movable contact 110 and moves toward the fixed contact, namely, downwardly, by an elastic force of the support spring 170 until such time as the stopper 161 comes into contact with the second opening end 131 of the moving side shield 130. Then, as the push pin 162 of the push link 160 moves downwardly, it downwardly presses the rotation recess 153 which is eccentric with respect to the hinge portion 151 of the insulating screen 150. Then, the insulating screen 150 is rotated in the clockwise direction based on the hinge portion 151 in the drawing, to open the second opening end 131 of the moving side shield 130. Then, the movable contact 110 passes through the opened second opening end 131 of the moving side shield 130 to move toward the fixed contact.

Meanwhile, in order for the disconnecting switch to be changed from the closed circuit state to the open circuit state, the movable link 110 rotates in the clockwise direction in FIG. 6. Then, the movable contact 110 coupled to the movable link 3 is separated from the fixed contact 210 and moves upwardly so as to be returned into the moving side shield 130, and as the moving side tulip contact 120 is separated from the fixed side tulip contact 220, the opening operation is completed.

In this case, the constraint pin 180 is pushed by the constraint spring 190 and inserted into the push recess 112 of the movable contact 110 so as to be caught by the stop surface 112*a*. In this state, when the movable contact 110 continuously moves upwardly, the constraint pin 180 moves upwardly along with the movable contact 110 to push the push link 160 upwardly. Then, the push link 160 is moved upwardly to pressurize the support spring 170.

At the same time, the push pin 162 insertedly positioned in the rotation recess 153 of the insulating screen 150 is moved upwardly to rotate the insulating screen 150 in the counterclockwise direction in FIG. 6, so the insulating screen 150 blocks the second opening end 131 of the moving side shield 130. Then, the space between the movable contact 110 and the fixed contact 210 is blocked by the insulating screen 150, thus preventing a concentration of an electric field to the movable contact 110 and the fixed contact 210.

A gas insulated switchgear according to another embodiment of the present invention will be described.

Figure 7:
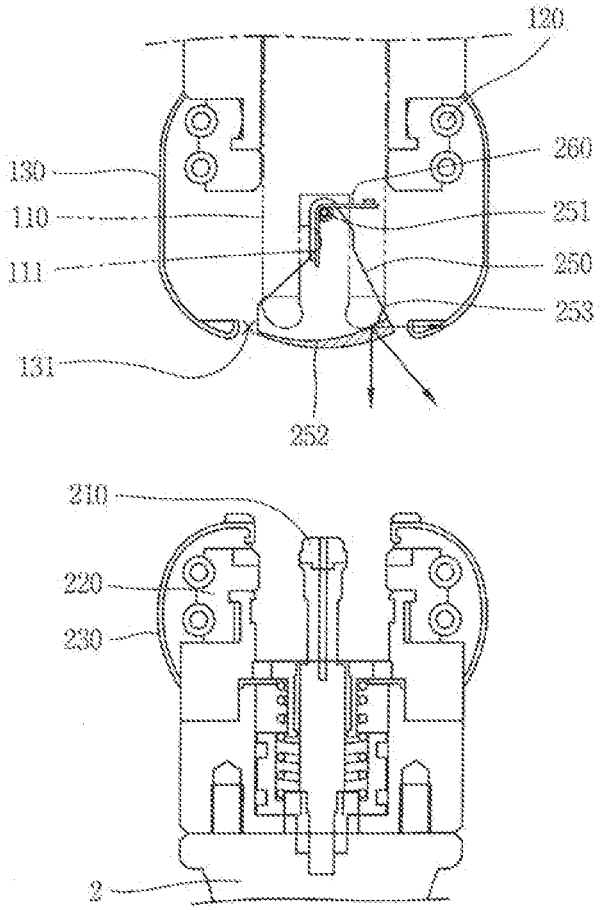
FIG. 7 is a vertical sectional views showing another example of a contact structure of the disconnecting switch in the gas insulated switchgear according to an embodiment of the present invention.
Figure 8:
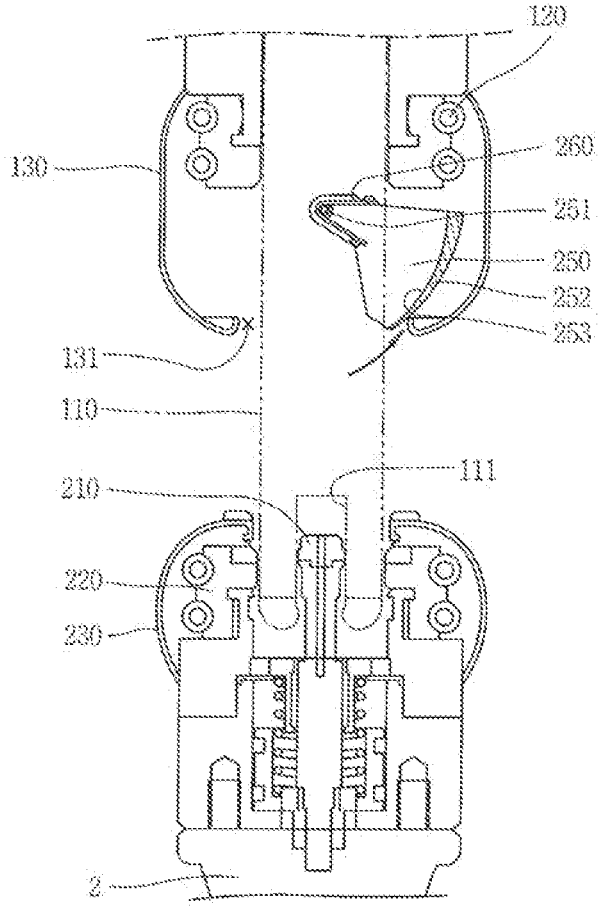
FIGS. 8 and 9 are vertical sectional views showing contact structures in a closed circuit state and an open circuit state of the disconnecting switch in FIG. 7, respectively.
Figure 9:
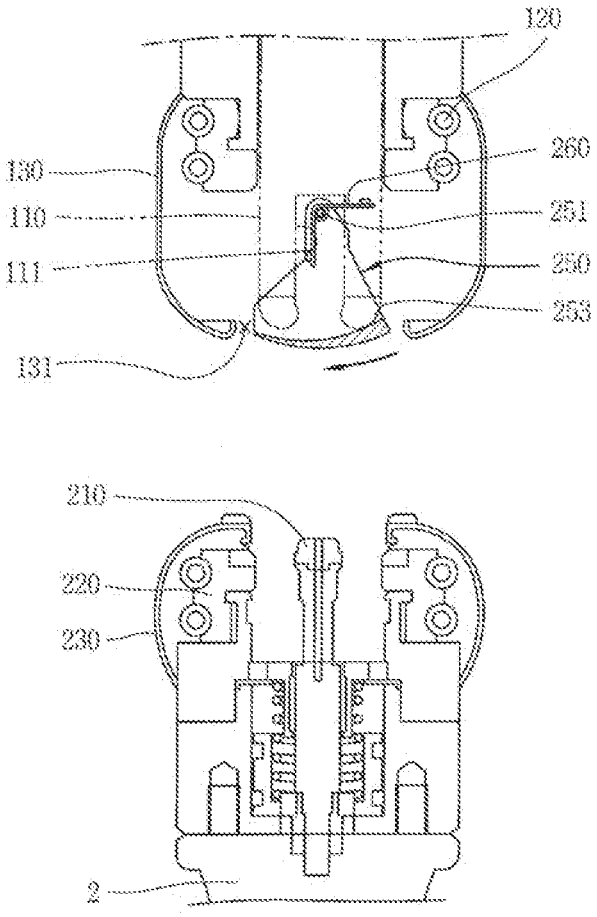

In the foregoing embodiment, the moving side shield is opened and closed as the insulating screen is rotated by the link. In comparison, in the present embodiment, the insulating screen is rotated by the movable contact. FIG. 7 is a vertical sectional views showing another example of a contact structure of the disconnecting switch in the gas insulated switchgear according to an embodiment of the present invention. FIGS. 8 and 9 are vertical sectional views showing contact structures in a closed circuit state and an open circuit state of the disconnecting switch in FIG. 7, respectively.

As illustrated, an insulating screen 250 may be configured such that a push surface 253 is formed to be sloped or rounded on an inner circumferential surface of a blocking portion 252. The push surface 253 may be formed to be in contact with a portion eccentric with respect to the center of the movable contact 110 in an axial direction. A hinge portion 251 may be formed at the center of the blocking portion 252 or formed to be eccentric toward a side in contact with the blocking portion 252. A return spring 260 may be coupled to the insulating screen 250 in order to return the insulating screen 250 when the movable contact 110 is returned to the moving side shield 130.

In the gas insulated switchgear according to the present embodiment, when the movable contact 110 is changed to a closed circuit state, as shown in FIG. 8, the end of the movable contact 110 moves downwardly to push the blocking portion 252 of the insulating screen 250. Then, the blocking portion 250 of the insulating screen 250 eccentrically in contact with the end surface of the movable contact 110 receives a pushing force from the movable contact 110, so the insulating screen 250 is rotated in a direction which is eccentric based on the hinge portion 251, namely, in the counterclockwise direction in the drawing. Then, the insulating screen 250 is rotated in the second opening end 131 of the moving side shield 130, thus opening the second opening end 131.

Meanwhile, when the movable contact is changed to the open circuit state, as shown in FIG. 9, the movable contact 110 moves upwardly so as to be returned into the moving side shield 130, so the blocking portion 252 of the insulating screen 250 becomes free. Then, the return spring 260 is restored to rotate the insulating screen 250 in the clockwise direction in the drawing, thus blocking the second opening 131 of the moving side shield 130. Then, a space between the movable contact 110 and the fixed contact 210 is blocked by the insulating screen 250, thus preventing a concentration of an electric field on the movable contact 110 and the fixed contact 210.

In this manner, in the gas insulated switchgear, in the case of the closed circuit, when the movable contact moves toward the fixed contact, the insulating screen unit opens the opening end of the moving side shield, and in the case of the open circuit, when the movable contact is returned, the insulating screen unit blocks the opening end of the moving side shield. Thus, a concentration of an electric field between the contacts can be lessened and the contacts can be prevented from being contaminated.

What is claimed is:

1. A gas insulated switchgear comprising:
an upper conductor;
a lower conductor;
a movable contact provided in the upper conductor such that it is movable linearly with respect to the upper contact;
a fixed contact fixedly provided in the lower conductor;
a moving side tulip contact provided in the movable contact;
a moving side shield fixed to the upper conductor, accommodating the moving side tulip contact, and having an opening end allowing the movable contact to pass therethrough;
a fixed side tulip contact provided in the fixed contact and selectively connected to the moving side tulip contact by the movable contact;
a fixed side shield fixed to the lower conductor and accommodating the fixed side tulip contact; and
an insulating screen unit installed to selectively block the opening end of the moving side shield and covering an end of the movable contact when the movable contact is separated from the fixed contact.

2. The gas insulated switchgear of claim 1, wherein the insulating screen unit comprises:
an insulating screen rotatably coupled to the moving side shield and blocking the opening end of the moving side shield; and
a push link slidably coupled to the insulating screen and provided within the moving side in order to rotate the insulating screen within a certain range.

3. The gas insulated switchgear of claim 2, wherein the insulating screen unit further comprises:
a support spring supporting the push link in a direction of the lower conductor.

4. The gas insulated switchgear of claim 2, wherein the insulating screen unit further comprises:
a constraint pin provided to be selectively inserted into a lateral surface of the movable contact in order to selectively restrain a movement of the push link; and
a constraint spring elastically supporting the constraint pin in the direction of the movable contact.

5. The gas insulated switchgear of claim 4, wherein a push recess is formed on a lateral surface of the movable contact to allow the constraint pin to be selectively inserted therein, and the push recess includes a stop surface having a step to allow the constraint pin to be caught thereby in the direction of the lower conductor and a guide surface sloped to allow the constraint pin to slide therealong in the direction of the upper conductor.

6. The gas insulated switchgear of claim 2, wherein the insulating screen includes a hinge portion rotatably formed in the moving side shield and a blocking portion formed at the opposite side of the hinge portion to block the opening end of the moving side shield.

7. The gas insulated switchgear of claim 6, wherein a rotation recess is formed between the hinge portion and the blocking portion in order to allow a push pin provided in the push link to be slidably inserted therein to make the insulating screen rotate when the push link is moved.

8. The gas insulated switchgear of claim 1, wherein the insulating screen unit comprises:
an insulating screen rotatably coupled to the moving side shield such that it is pushed by the movable contact to open the opening end of the moving side shield; and
a return spring coupled between the moving side shield and the insulating screen and providing elastic force to the insulating screen to block the opening end of the moving side shield when the movable contact is returned into the moving side shield.

9. The gas insulated switchgear of claim 8, wherein the insulating screen includes a hinge portion rotatably formed in the moving side shield and a blocking portion formed at the opposite side of the hinge portion to block the opening end of the moving side shield.

10. The gas insulated switchgear of claim 9, wherein a push surface is formed on an inner circumferential surface of the blocking portion and disposed to be in contact with the movable contact such that it is eccentric with respect to a central line of a movement direction of the movable contact.

11. A gas insulated switchgear comprising:
a moving side tulip contact provided in a movable contact;
a moving side shield accommodating the moving side tulip contact and having an opening end allowing the movable contact to pass therethrough;
a fixed side tulip contact provided in a fixed contact and selectively connected to the moving side tulip contact;
a fixed side shield accommodating the fixed side tulip contact;
an insulating screen rotatably coupled to the moving side shield and blocking the opening of the moving side shield;
a push link slidably coupled to the insulating screen and provided within the moving side shield to rotate the insulating screen within a certain range; and
a constraint pin provided to be selectively inserted into a lateral surface of the movable contact and selectively restraining a movement of the push link.

12. The gas insulated switchgear of claim 11, further comprising:
a support spring supporting the push link toward the fixed contact; and
a constraint spring elastically supporting the constraint pin toward the movable contact.

13. The gas insulated switchgear of claim 11, wherein the insulating screen includes a hinge portion rotatably formed in the moving side shield and a blocking portion formed at the opposite side of the hinge portion to block the opening end of the moving side shield, and a rotation recess is formed between the hinge portion and the blocking portion in order to allow a push pin provided in the push link to be slidably inserted therein to make the insulating screen rotate when the push link is moved.

14. A gas insulated switchgear comprising:

a moving side tulip contact provided in a movable contact;

a moving side shield accommodating the moving side tulip contact and having an opening end allowing the movable contact to pass therethrough;

a fixed side tulip contact provided in a fixed contact and selectively connected to the moving side tulip contact;

a fixed side shield accommodating the fixed side tulip contact;

an insulating screen rotatably coupled to the moving side shield such that it is pushed by the movable contact to open the opening end of the moving side shield; and a return spring coupled between the moving side shield and the insulating screen and providing an elastic force to the insulating screen to block the opening end of the moving side shield when the movable contact is returned into the moving side shield.

15. The gas insulated switchgear of claim 14, wherein the insulating screen includes a hinge portion rotatably formed in the moving side shield and a blocking portion formed at the opposite side of the hinge portion to block the opening end of the moving side shield, and a push surface is formed on an inner circumferential surface of the blocking portion and disposed to be in contact with the movable contact such that it is eccentric with respect to a central line of a movement direction of the movable contact.

* * * * *